US010316421B2

(12) United States Patent
Sakurai et al.

(10) Patent No.: US 10,316,421 B2
(45) Date of Patent: Jun. 11, 2019

(54) COPPER-NICKEL ALLOY ELECTROPLATING BATH

(71) Applicant: DIPSOL CHEMICALS CO., LTD., Tokyo (JP)

(72) Inventors: Hitoshi Sakurai, Matsudo (JP); Kazunori Ono, Tokyo (JP); AKira Hashimoto, Funabashi (JP); Satoshi Yuasa, Narashino (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 145 days.

(21) Appl. No.: 15/502,197

(22) PCT Filed: Jul. 10, 2015

(86) PCT No.: PCT/JP2015/069944
§ 371 (c)(1),
(2) Date: Feb. 6, 2017

(87) PCT Pub. No.: WO2016/021369
PCT Pub. Date: Feb. 11, 2016

(65) Prior Publication Data

US 2017/0241031 A1 Aug. 24, 2017

(30) Foreign Application Priority Data

Aug. 8, 2014 (JP) ..... 2014-162802

(51) Int. Cl.
*C25D 3/56* (2006.01)
*C25D 3/58* (2006.01)

(52) U.S. Cl.
CPC ..... *C25D 3/58* (2013.01); *C25D 3/562* (2013.01)

(58) Field of Classification Search
CPC ..... C25D 3/56; C25D 3/562; C25D 3/58
USPC ..... 205/239, 259
See application file for complete search history.

(56) References Cited

U.S. PATENT DOCUMENTS

| | | | | | |
|---|---|---|---|---|---|
| 1,837,835 | A * | 12/1931 | Pinner | C25D 3/12 | 205/101 |
| 3,833,481 | A | 9/1974 | Olson et al. | | |
| 2015/0090600 | A1 * | 4/2015 | Inoue | C25D 3/58 | 205/162 |

FOREIGN PATENT DOCUMENTS

| | | | | | |
|---|---|---|---|---|---|
| CN | 104233302 | A * | 12/2014 | C23F 1/18 | |
| JP | 58-133391 | A | 8/1983 | | |
| JP | 02-285091 | A | 11/1990 | | |
| JP | 05-098488 | A | 4/1993 | | |
| KR | 20100076526 | A * | 7/2010 | C25D 3/56 | |
| RU | 2106436 | | 3/1998 | | |
| WO | WO-2013/157639 | A1 | 10/2013 | | |
| WO | WO-2013157639 | A1 * | 10/2013 | C25D 3/58 | |

OTHER PUBLICATIONS

Silaimani et al., "Nickel-Copper Alloy Electrofornning from the Citrate-Sulphamate Mixed Bath," Bulletin of Electrochemistry (Jul. 2000), vol. 16, No. 7, pp. 326-328. (Year: 2000).*

Extended European Search Report issued for EP 15829590.7 dated Dec. 20, 2017.

International Search Report and Written Opinion for PCT/JP2015/06994 dated Sep. 29, 2015.

* cited by examiner

*Primary Examiner* — Edna Wong
(74) *Attorney, Agent, or Firm* — Foley & Lardner LLP

(57) ABSTRACT

The present invention provides a copper-nickel alloy electroplating bath which contains (a) a copper salt and a nickel salt, (b) a metal complexing agent, (c) a conductivity imparting agent, (d) a sulfur-containing organic compound and (e) a redox potential regulator.

7 Claims, No Drawings

COPPER-NICKEL ALLOY ELECTROPLATING BATH

CROSS REFERENCE TO RELATED APPLICATIONS

The present application is a national stage application, filed under 35 U.S.C. § 371, of PCT Application No. PCT/JP2015/069944, filed Jul. 10, 2015, entitled "COPPER-NICKEL ALLOY ELECTROPLATING BATH," which claims priority to Japanese Application No. 2014-162802, filed Aug. 8, 2014, all of which are hereby incorporated by reference in their entireties.

TECHNICAL FIELD

The present invention relates to a copper-nickel alloy electroplating bath. More specifically, the present invention relates to a copper-nickel alloy electroplating bath that is capable of obtaining a plated coating on a workpiece at any alloy ratio of copper and nickel with a uniform composition over a wide current density range and that has an excellent bath stability and is capable of being used continuously for a long period of time.

BACKGROUND

Generally, copper-nickel alloys exhibit excellent properties in corrosion resistance, ductility, processability, and high temperature characteristics by changing a ratio of copper and nickel, and also has characteristic properties in electrical resistivity, coefficient of heat resistance, thermal electromotive force, coefficient of thermal expansion, and the like. Thus, studies have hitherto been conducted to obtain such properties of copper-nickel alloys by electroplating. As conventionally attempted copper-nickel alloy electroplating baths, a large variety of baths have been studied, including a cyanide bath, a citric acid bath, an acetic acid bath, a tartaric acid bath, a thiosulfuric acid bath, an ammonia bath, and a pyrophosphoric acid bath; however, none of these baths have been put into practical use. The reasons why the copper-nickel alloy electroplating has not practically been used include: (i) copper and nickel differ from each other in deposition potential by approximately 0.6 V, so that copper is preferentially deposited; (ii) the plating bath is unstable, so that insoluble compounds such as metal hydroxides are generated; (iii) the plating composition varies due to energization, so that coating having a uniform composition cannot be stably obtained; (iv) the service life of the liquid is short; and the like.

DETAILED DESCRIPTION

To solve these problems, an object of the present invention is to provide a copper-nickel alloy electroplating bath:
(1) that is capable of depositing copper and nickel on a workpiece at any alloy ratio of copper and nickel;
(2) that is also capable of obtaining a plated coating with a uniform composition over a wide current density range;
(3) that has an excellent bath stability; and
(4) that is capable of being used for a long period of time.

As a result of earnest studies, the present inventors have found that the above object can be achieved by using a copper-nickel alloy electroplating bath comprising: (a) a copper salt and a nickel salt; (b) a metal complexing agent; (c) a conductivity providing salt; and (d) a sulfur-containing organic compound, and comprising (e) an oxidation-reduction potential adjusting agent, as a copper-nickel alloy electroplating bath, adjusting the oxidation-reduction potential (hereinafter sometimes referred to as ORP) of the copper-nickel alloy electroplating bath such that the ORP is constantly maintained to be equal to or higher than 20 mV (reference electrode Ag/AgCl) during plating operation, and also adjusting the ORP of the plating bath such that the ORP is constantly equal to or higher than 20 mV (reference electrode Ag/AgCl) even when energization (electrolysis) is conducted between a cathode (a workpiece) and an anode. In other words, the present invention provides a copper-nickel alloy electroplating bath comprising: (a) a copper salt and a nickel salt; (b) a metal complexing agent; (c) a conductivity providing salt; (d) a sulfur-containing organic compound; and (e) an oxidation-reduction potential adjusting agent.

According to the present invention, it is possible to provide a copper-nickel alloy electroplating bath:
(1) that is capable of depositing copper and nickel on a workpiece at any alloy ratio of copper and nickel;
(2) that is also capable of obtaining a plated coating with a uniform composition over a wide current density range;
(3) that has an excellent bath stability; and
(4) that is capable of being used for a long period of time.

DESCRIPTION OF EMBODIMENTS

A copper-nickel alloy electroplating bath of the present invention comprises: (a) a copper salt and a nickel salt; (b) a metal complexing agent; (c) a conductivity providing salt; (d) a sulfur-containing organic compound; and (e) an oxidation-reduction potential adjusting agent.

(a) Copper Salt and Nickel Salt

The copper salt includes, but is not limited to, copper sulfate, copper(II) halides, copper sulfamate, copper methanesulfonate, copper(II) acetate, basic copper carbonate, and the like. These copper salts may be used alone, or may be used as a mixture of two or more thereof. The nickel salt includes, but is not limited to, nickel sulfate, nickel halides, basic nickel carbonate, nickel sulfamate, nickel acetate, nickel methanesulfonate, and the like. These nickel salts may be used alone, or may be used as a mixture of two or more thereof. The concentrations of the copper salt and the nickel salt in the plating bath have to be selected in various manners in accordance with the composition of a plated coating to be desired. However, the concentration of copper ions is preferably 0.5 to 40 g/L, and more preferably 2 to 30 g/L, and the concentration of nickel ions is preferably 0.25 to 80 g/L, and more preferably 0.5 to 50 g/L. In addition, the total concentration of copper ions and nickel ions in the plating bath is preferably 0.0125 to 2 mol/L, and more preferably 0.04 to 1.25 mol/L.

(b) Metal Complexing Agent

The metal complexing agent stabilizes metals, which are copper and nickel. The metal complexing agent includes, but is not limited to, monocarboxylic acids, dicarboxylic acids, polycarboxylic acids, oxycarboxylic acids, keto-carboxylic acids, amino acids, and amino carboxylic acids, as well as salts thereof, and the like. Specifically, the metal complexing agent includes malonic acid, maleic acid, succinic acid, tricarballylic acid, citric acid, tartaric acid, malic acid, gluconic acid, 2-sulfoethylimino-N,N-diacetic acid, iminodiacetic acid, nitrilotriacetic acid, EDTA, triethylenediaminetetraacetic acid, hydroxyethyliminodiacetic acid, glutamic acid, aspartic acid, β-alanine-N,N-diacetic acid, and the like. Among these, malonic acid, citric acid, malic acid, gluconic acid, EDTA, nitrilotriacetic acid, and glutamic acid are preferable. In addition, the salts of these carboxylic acids include, but are not limited to, magnesium salts, sodium salts, potassium salts, ammonium salts, and the like. These metal complexing agents may be used alone, or may be used as a mixture of two or more thereof. The concentration of the metal complexing agent in the plating bath is preferably 0.6 to 2 times, and more preferably 0.7 to 1.5 times, the metal ion concentration (molar concentration) in the bath.

(c) Conductivity Providing Salt

The conductivity providing salt provides electrical conductivity to the copper-nickel alloy electroplating bath. In the present invention, the conductivity providing salt includes inorganic halide salts, inorganic sulfates, lower alkane (preferably C1 to C4) sulfonates, and alkanol (preferably C1 to C4) sulfonates.

The inorganic halide salts include, but are not limited to, chloride salts, bromide salts, and iodized salts of magnesium, sodium, potassium, and ammonium, and the like. These inorganic halide salts may be used alone, or may be used as a mixture of two or more thereof. The concentration of the inorganic halide salt in the plating bath is preferably 0.1 to 2 mol/L, and more preferably 0.2 to 1 mol/L.

The inorganic sulfates include, but are not limited to, magnesium sulfate, sodium sulfate, potassium sulfate, ammonium sulfate, and the like. These inorganic sulfates may be used alone, or may be used as a mixture of two or more thereof.

The lower alkane sulfonates and the alkanol sulfonates include, but are not limited to, magnesium salts, sodium salts, potassium salts, ammonium salts, and the like, and more specifically include magnesium, sodium, potassium, and ammonium salts of methanesulfonic acid and 2-hydroxypropanesulfonic acid, and the like. These sulfonates may be used alone, or may be used as a mixture of two or more thereof.

The concentration of the sulfate and/or the sulfonate in the plating bath is preferably 0.25 to 1.5 mol/L, and more preferably 0.5 to 1.25 mol/L.

Moreover, it is more effective to use a plurality of conductivity providing salts different from each other as the conductivity providing salt. It is preferable to comprise an inorganic halide salt and a salt selected from the group consisting of inorganic sulfates and the sulfonates, as the conductivity providing salt.

(d) Sulfur-Containing Organic Compound

The sulfur-containing organic compound preferably includes a compound selected from the group consisting of disulfide compounds, sulfur-containing amino acids, benzothiazolylthio compounds, and salts thereof.

The disulfide compound includes, but is not limited to, disulfide compounds represented by the general formula (I), and the like:

$$A\text{-}R^1\text{—S—S—}R^2\text{-}A \quad (I)$$

wherein $R^1$ and $R^2$ represent hydrocarbon groups, A represents a $SO_3Na$ group, a $SO_3H$ group, an OH group, a $NH_2$ group, or a $NO_2$ group.

In the formula, the hydrocarbon group is preferably an alkylene group, and more preferably an alkylene group having 1 to 6 carbon atoms. Specific examples of the disulfide compounds include, but are not limited to, bis-sodium sulfoethyl disulfide, bis-sodium sulfopropyl disulfide, bis-sodium sulfopentyl disulfide, bis-sodium sulfohexyl disulfide, bis-sulfoethyl disulfide, bis-sulfopropyl disulfide, bis-sulfopentyl disulfide, bis-aminoethyl disulfide, bis-aminopropyl disulfide, bis-aminobutyl disulfide, bis-aminopentyl disulfide, bis-hydroxyethyl disulfide, bis-hydroxypropyl disulfide, bis-hydroxybutyl disulfide, bis-hydroxypentyl disulfide, bis-nitroethyl disulfide, bis-nitropropyl disulfide, bis-nitrobutyl disulfide, sodium sulfoethyl propyl disulfide, sulfobutyl propyl disulfide, and the like. Among these disulfide compounds, bis-sodium sulfopropyl disulfide, bis-sodium sulfobutyl disulfide, and bis-aminopropyl disulfide are preferable.

The sulfur-containing amino acids include, but are not limited to, sulfur-containing amino acids represented by the general formula (II), and the like:

$$R\text{—S—}(CH_2)_n\text{CHNHCOOH} \quad (II)$$

wherein R represents a hydrocarbon group, or —H or —$(CH_2)_n$CHNHCOOH, and each n is independently 1 to 50.

In the formula, the hydrocarbon group is preferably an alkyl group, and more preferably an alkyl group having 1 to 6 carbon atoms. Specific examples of the sulfur-containing amino acids include, but are not limited to, methionine, cystine, cysteine, ethionine, cystine disulfoxide, cystathionine, and the like.

The benzothiazolylthio compounds include, but are not limited to, benzothiazolyl compounds represented by the general formula (III), and the like:

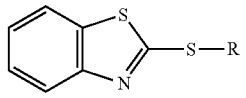

(III)

wherein R represents a hydrocarbon group, or —H or —$(CH_2)_n$COOH.

In the formula, the hydrocarbon group is preferably an alkyl group, and more preferably an alkyl group having 1 to 6 carbon atoms. In addition, n=1 to 5. Specific examples of the benzothiazolylthio compounds include, but are not limited to, (2-benzothiazolyl thio)acetic acid, 3-(2-benzothiazolyl thio)propionic acid, and the like. In addition, the salts thereof include, but are not limited to, sulfate, halide salt, methanesulfonate, sulfamate, acetate, and the like.

These disulfide compounds, sulfur-containing amino acids, and benzothiazolylthio compounds as well as the salts thereof may be used alone, or may be used as a mixture of two or more thereof. The concentration of a compound selected from the group consisting of disulfide compounds, sulfur-containing amino acids, and benzothiazolylthio compounds as well as the salts thereof in the plating bath is preferably 0.01 to 10 g/L, and more preferably 0.05 to 5 g/L.

In addition, it is more effective to use a compound selected from the group consisting of disulfide compounds, sulfur-containing amino acids, and benzothiazolylthio compounds as well as salts thereof, and a compound selected from the group consisting of sulfonic acid compounds, sulfimide compounds, sulfamic acid compounds, and sulfonamides as well as salts thereof in combination as the sulfur-containing organic compound. The use of a compound selected from the group consisting of sulfonic acid compounds, sulfimide compounds, sulfamic acid compounds, and sulfonamides as well as salts thereof in combination makes the copper-nickel alloy electroplated coating dense.

The sulfonic acid compounds and salts thereof include, but are not limited to, aromatic sulfonic acids, alkene sulfonic acids, and alkyne sulfonic acid as well as salts thereof. Specifically, the sulfonic acid compounds and salts thereof include, but are not limited to, sodium 1,5-naphthalenedisulfonate, sodium 1,3,6-naphthalenetrisulfonate, sodium 2-propene-1-sulfonate and the like.

The sulfimide compounds and salts thereof include, but are not limited to, benzoic sulfimide (saccharin) and salts thereof, and the like. Specifically, the sulfimide compounds and salts include, but are not limited to, saccharin sodium and the like.

The sulfamic acid compounds and salts thereof include, but are not limited to, acesulfame potassium, sodium N-cyclohexylsulfamate, and the like.

The sulfonamides and salts thereof include, but are not limited to, para-toluene sulfonamide and the like.

These sulfonic acid compounds, sulfimide compounds, sulfamic acid compounds, and sulfonamides as well as salts thereof may be used alone, or may be used as a mixture of two or more thereof. The concentration of a compound selected from the group consisting of sulfonic acid compounds, sulfimide compounds, sulfamic acid compounds, and sulfonamides as well as salts thereof in the plating bath is preferably 0.2 to 5 g/L, and more preferably 0.4 to 4 g/L.

(e) ORP Adjusting Agent

The oxidation-reduction potential adjusting agent is preferably an oxidant, and is, for example, an inorganic or organic oxidant. Such an oxidant includes, for example, hydrogen peroxide solutions, and water-soluble oxoacids, as well as salts thereof. The water-soluble oxoacids and salts thereof include inorganic and organic oxoacids.

When electroplating is performed by energizing between the cathode (workpiece) and the anode, divalent copper ions are deposited as metallic copper on the cathode by reduction reaction, and subsequently, the deposited metallic copper generates monovalent copper ions by dissolution reaction and the like. Then, the generation of such monovalent copper ions lowers the oxidation-reduction potential of the plating bath. The ORP adjusting agent is assumed to act as an oxidant for monovalent copper ions, which oxidizes monovalent copper ions to divalent copper ions, preventing the oxidation-reduction potential of the plating bath from being lowered.

Preferable inorganic oxoacids include halogen oxoacids such as hypochlorous acid, chlorous acid, chloric acid, perchloric acid, and bromic acid, and alkali metal salts thereof, nitric acid and alkali metal salts thereof, as well as persulfuric acid and alkali metal salts thereof.

Preferable organic oxoacids and salts thereof include aromatic sulfonates such as sodium 3-nitrobenzenesulfonate and percarboxylates such as sodium peracetate.

In addition, water-soluble inorganic compounds and organic compounds that are used also as pH buffers, as well as alkali metal salts thereof can also be used as the ORP adjusting agent. Such ORP adjusting agents include, preferably boric acid, phosphoric acid, and carbonic acid as well as alkali metal salts thereof, and the like, and also carboxylic acids such as formic acid, acetic acid, and succinic acid as well as alkali metal salts thereof, and the like.

Such ORP adjusting agents may be used alone, or may be used as a mixture of two or more thereof. When the ORP adjusting agent is an oxidant, the amount of the oxidant to be added is normally in a range of 0.01 to 5 g/L, and preferably in a range of 0.05 to 2 g/L. When the ORP adjusting agent is a pH buffer, the amount of the pH buffer to be added is normally in a range of 2 to 60 g/L, and preferably in a range of 5 to 40 g/L.

In the present invention, the oxidation-reduction potential (ORP) in the copper-nickel alloy electroplating bath needs to be constantly maintained at 20 mV (reference electrode (vs.) Ag/AgCl) or higher at a plating bath temperature, during plating operation. When the plating is being performed (during energizing), the oxidation-reduction potential normally decreases with time. In such case as well, the oxidation-reduction potential adjusting agent may additionally be added and used as appropriate to constantly maintain the oxidation-reduction potential (ORP) at 20 mV (vs. Ag/AgCl) or higher.

If the oxidation-reduction potential (ORP) in the bath becomes lower than or equal to 20 mV (vs. Ag/AgCl), deposition of plating becomes coarse, resulting in the formation of an uneven surface. Although there is no upper limit in the oxidation-reduction potential (ORP) in the bath, the ORP that is higher than or equal to 350 mV (vs. Ag/AgCl) is not favorable because such a high ORP affects organic substances contained in the bath, that is, (b) the metal complexing agent, (d) the sulfur-containing organic compound, and the like, thus lowering their effects, in some cases.

In the present invention, adding the surfactant to the copper-nickel alloy electroplating bath improves the uniformity of the plating composition and the smoothness of the plated surface. The surfactant includes water-soluble surfactants having a polymerizable group of an ethylene oxide or a propylene oxide, or a copolymerizable group of an ethylene oxide and a propylene oxide, as well as water-soluble synthetic polymers.

As the water-soluble surfactants, any of anionic surfactants, cationic surfactants, amphoteric surfactants, and nonionic surfactants may be used regardless of the ionicity, but nonionic surfactants are preferable. Although the water-soluble surfactants have a polymerizable group of an ethylene oxide or a propylene oxide, or a copolymerizable group of an ethylene oxide and a propylene oxide, the polymerization degree of these is 5 to 250, and preferably 10 to 150. These water-soluble surfactants may be used alone, or may be used as a mixture of two or more thereof. The concentration of the water-soluble surfactant in the plating bath is preferably 0.05 to 5 g/L, and more preferably 0.1 to 2 g/L.

The water-soluble synthetic polymers include reaction products of glycidyl ethers and polyvalent alcohols. The reaction products of glycidyl ethers and polyvalent alcohols make the copper-nickel alloy electroplated coating dense and further are effective in making the plating composition uniform.

The glycidyl ethers, which are reaction raw materials of the reaction products of glycidyl ethers and polyvalent alcohols, include, but are not limited to, glycidyl ethers containing two or more epoxy groups in molecule, glycidyl ethers containing one or more hydroxyl groups and one or more epoxy groups in molecule, and the like. Specifically, the glycidyl ethers include glycidol, glycerol polyglycidyl ether, ethylene glycol diglycidyl ether, polyethylene glycol diglycidyl ether, polypropylene glycol diglycidyl ether, sorbitol polyglycidyl ether, and the like.

The polyvalent alcohols include, but are not limited to, ethylene glycol, propylene glycol, glycerin, polyglycerin, and the like.

The reaction product of a glycidyl ether and a polyvalent alcohol is preferably a water-soluble polymer that is obtained by condensation reaction between an epoxy group of the glycidyl ether and a hydroxyl group of the polyvalent alcohol.

These reaction products of glycidyl ethers and polyvalent alcohols may be used alone, or may be used as a mixture of two or more thereof. The concentration of the reaction product of a glycidyl ether and a polyvalent alcohol in the plating bath is preferably 0.05 to 5 g/L, and more preferably 0.1 to 2 g/L.

In the present invention, although there is no particular limit in the pH of the copper-nickel alloy electroplating bath, the pH of the copper-nickel alloy electroplating bath is normally in a range of 1 to 13, and preferably in a range of 3 to 8. The pH of the plating bath may be adjusted by using a pH modifier such as sulfuric acid, hydrochloric acid, hydrobromic acid, methanesulfonic acid, sodium hydroxide, potassium hydroxide, ammonia water, ethylenediamine, diethylenetriamine, triethylenetetramine. When the plating operation is being performed, it is preferable to maintain the pH of the plating bath at a constant level by using the pH modifier.

Next, a plating method using the plating bath of the present invention will be described. Workpieces that can be electroplated by using the plating bath of the present invention include copper, iron, nickel, silver, gold, and alloys thereof, and the like. In addition, substrates having surfaces modified with the metal or alloy may be used as the workpiece. Such substrates include glass substrate, ceramic substrate, plastic substrate, and the like.

When electroplating is performed, insoluble anodes of carbon, platinum, platinum-plated titanium, indium oxide-coated titanium, and the like may be used as the anode. Alternatively, soluble anodes using copper, nickel, copper-nickel alloy, or both copper and nickel together, and the like may be used.

Moreover, in the electroplating method using the copper-nickel alloy electroplating bath of the present invention, it is preferable to use a plating tank in which the substrate to be plated (cathode) and the anode electrode are separated by a membrane in the plating tank. The membrane is preferably a neutral membrane or an ion-exchange membrane. The neutral membranes include one having a substrate of polyethylene terephthalate resin with a membrane material of poly vinylidene difluoride resin titanium oxide/sucrose fatty acid ester. In addition, as the ion-exchange membrane, a cation-exchange membrane is suitable.

Although the copper-nickel alloy electroplating bath of the present invention allows a plated coating of a desired composition with a copper/nickel composition ratio of the metal coating to be deposited being 5/95 to 99/1 to be obtained, the copper/nickel composition ratio is preferably 20/80 to 98/2, and more preferably 50/50 to 95/5.

When plating is performed, the workpiece is brought to the plating step after being pre-treated by a conventional method. In the pre-treatment step, at least one operation of soak cleaning, electrolytic cleaning of the cathode or the anode, acid pickling, and activation is performed. Water cleaning is performed between every successive operations. After the plating, the coating thus obtained may be cleaned with water or hot water, and then dried. In addition, after the plating of a copper-nickel alloy, an anti-oxidation treatment or the plating of tin or a tin alloy, or the like may be performed. In the present invention, the plating bath is capable of being used for a long period of time without liquid updating, by maintaining the bath components at a constant level with an appropriate replenishing agent.

When electroplating is performed by using the copper-nickel alloy electroplating bath of the present invention, direct current or pulsed current may be used as the plating current onto the substrate to be plated and the anode electrode in the copper-nickel alloy electroplating bath.

The cathode current density is normally 0.01 to 10 A/dm$^2$, and preferably 0.1 to 8.0 A/dm$^2$.

The plating time is normally in a range of 1 to 1200 minutes, and preferably in a range of 15 to 800 minutes although it also depends on the film thickness of plating to be required, and the current condition.

The bath temperature is normally 15 to 70° C., and preferably 20 to 60° C. The bath may be stirred by air or liquid flow, or mechanical liquid stirring using a cathode rocker, a paddle, and the like. The film thickness may be set in a wide range, but is generally 0.5 to 100 μm, and preferably 3 to 50 μm.

Next, the present invention will be described with Examples, but the present invention is not limited to these Examples. The compositions of the plating bath and the plating conditions may be changed as desired along with the concepts of the above-described object for obtaining copper-nickel alloy plating that is capable of obtaining a plated coating on a workpiece at any alloy ratio of copper and nickel with a uniform composition over a wide current density range and that has an excellent bath stability and is capable of being used continuously for a long period of time.

EXAMPLES

Plating in Examples was evaluated by using a test piece formed by sealing one surface of an iron plate (SPCC) of 0.5×65×100 mm with a Teflon (Registered Trademark) tape. The iron plate as the test piece was degreased using 50 g/L Dasshi-39 (manufactured by Dipsol Chemicals Co., Ltd.), and was cleaned with 10.5% by weight hydrochloric acid, followed by electrolysis cleaning with 5% by weight NC-20 (manufactured by Dipsol Chemicals Co., Ltd.) and a solution of 7 g/L sodium hydroxide. After the electrolysis cleaning, the test piece was then activated with 3.5% hydrochloric acid. Water cleaning was sufficiently performed between every successive operations. Further, the test piece was subjected to copper strike plating with the cyanide bath to obtain 0.3 μm of deposition.

In addition, the method of measuring the oxidation-reduction potential (ORP) of the plating liquid was such that the oxidation-reduction potential (ORP) was measured by using a portable ORP meter (manufactured by Horiba, Ltd.; a portable ORP meter D-72, reference electrode Ag/AgCl) at a bath temperature (normally 15° C. to 70° C.) during plating operation, and by dipping the electrodes of the ORP meter in the plating liquid and reading a numerical value (mV).

Examples 1 to 9 and Comparative Examples 1 to 6

Next, plating liquids shown in Table-1 were poured into a plating tank made of acrylic resin, a copper plate was used as the anode, the above-described test piece was connected to the cathode and was plated under conditions shown in Table-2. Results of evaluations of the film thickness, alloy composition, plated surface state, and plating external appearance (including color tone, smoothness, and glossiness) of obtained plating are shown in Table-3 and Table-4.

Note that, the film thickness of the copper strike plating is incomparably smaller than the film thickness of the copper-nickel alloy electroplating, and is such a level that the influence on the film thickness and the alloy composition of the copper-nickel alloy electroplating is negligible.

Moreover, the film thickness, the alloy composition, the plated surface state, and the plating external appearance of the plating were evaluated as follows:

(1) The film thickness of the plating was measured using an X-ray fluorescence spectrometer.

(2) The alloy composition of the plating was evaluated by measuring the alloy composition of the plating section using an energy-dispersive X-ray spectrometer, and evaluating the uniformity of the plated coating.

(3) The plated surface state (smoothness) was observed and evaluated using a scanning electron microscope.

(4) The external appearance (color tone) of the plating was visually observed.

Regarding Comparative Examples as well, plating was conducted using plating liquids of compositions shown in Table-5 under conditions shown in Table-6 in the same manner as that in Examples. Results of evaluations of the film thickness, alloy composition, plated surface state, and plating external appearance of the obtained plating are shown in Table-7.

TABLE 1

Compositions of Plating Liquids of Examples 1 to 9

| Concentrations of Components | Examples 1 | 2 | 3 | 4 | 5 | 6 | 7 | 8 | 9 |
|---|---|---|---|---|---|---|---|---|---|
| (a) $Cu^{2+}$ (g/L) | 5 | 5 | 5 | 10 | 10 | 10 | 15 | 15 | 15 |
| (a) $Ni^{2+}$ (g/L) | 10 | 5 | 2 | 15 | 10 | 5 | 25 | 15 | 5 |
| Concentration of Metals (mol/L) ($Cu^{2+}$ + $Ni^{2+}$) | 0.25 | 0.16 | 0.11 | 0.41 | 0.33 | 0.24 | 0.66 | 0.49 | 0.32 |
| (b) Malonic Acid (mol/L) | 0.38 | — | — | 0.62 | — | — | 0.99 | — | — |
| (b) Citric Acid (mol/L) | — | — | 0.08 | — | — | 0.24 | — | — | 0.22 |
| (b) Nitrilotriacetic Acid (mol/L) | — | 0.16 | — | — | 0.23 | — | — | 0.49 | — |
| Metal Complexing Agent/Metal Molar Concentration Ratio (Fold) | 1.5 | 1.0 | 0.7 | 1.5 | 0.7 | 1.0 | 1.5 | 1.0 | 0.7 |
| (c) Sodium Chloride (mol/L) | 0.2 | 0.5 | — | — | 0.25 | — | 1.0 | 0.5 | — |
| (c) Potassium Bromide (mol/L) | — | — | 0.25 | 1.0 | — | 0.2 | — | — | 0.25 |
| (c) Magnesium Sulfate (mol/L) | — | 1.0 | — | — | — | 0.5 | — | — | 0.75 |
| (c) Sodium Methanesulfonate (mol/L) | — | — | — | — | 1.25 | — | — | 0.5 | — |
| (d) Bis-sodium Sulfopropyl Disulfide (g/L) | 0.05 | — | 0.1 | — | — | 0.1 | 4.0 | — | 0.5 |
| (d) Cysteine Methanesulfonate (g/L) | — | 0.2 | — | 0.2 | 2.0 | — | — | 1.0 | — |
| (d) Sodium 1,5-naphthalenedisulfonate (g/L) | — | — | 2.0 | — | — | — | 4.0 | — | — |
| (d) Saccharin Sodium (g/L) | — | 0.4 | — | — | 2.0 | — | — | — | 1.0 |
| (e) 35%-Hydrogen Peroxide Solution (g/L) | — | 0.05 | — | — | 1.0 | — | — | 2.0 | — |
| (e) Peroxyacetic Acid (g/L) | — | — | — | 0.5 | — | — | — | — | — |
| (e) Boric Acid (g/L) | 40 | — | — | 20 | — | 40 | 30 | — | — |
| (e) Succinic Acid (g/L) | — | — | 20 | — | 10 | — | — | — | 40 |
| Reaction Product of Ethylene Glycol Diglycidyl Ether and Propylene Glycol (g/L) | — | 0.1 | — | — | — | — | — | 2.0 | — |
| Reaction Product of Glycerol Polyglycidyl Ether and Polyglycerin (g/L) | — | — | — | 0.5 | — | — | 0.2 | — | — |
| Polyethylene Glycol (g/L) | — | — | — | — | — | 1.0 | — | — | — |
| pH | 4 | 5 | 6 | 4 | 5 | 6 | 3 | 8 | 6 |
| ORP Before Plating Energization (mV) | 300 | 234 | 256 | 320 | 320 | 176 | 260 | 210 | 176 |

Types of Copper Salts: copper(II) sulfamate (Examples 1 and 7), copper(III) sulfate (Examples 2, 6 and 9), copper(II) acetate (Examples 3 and 4), copper(II) methanesulfonate (Examples 5 and 8) Types of Nickel Salts: nickel sulfamate (Examples 1 and 7), nickel sulfate (Examples 2, 6, and 9), nickel acetate (Examples 3 and 4), nickel methanesulfonate (Examples 5 and 8) pH Modifiers: sodium hydroxide (Examples 1, 2, 5, 7, and 8), potassium hydroxide (Examples 3, 4, 6, and 9)

TABLE 2

Plating Conditions of Examples 1 to 9

| Items | | Plating Conditions: Cathode Current Density at Direct Current Portion or Peak Portion ($A/dm^2$) | Current Type | Plating Time (min) | Bath Temperature (° C.) | With/Without Stirring |
|---|---|---|---|---|---|---|
| Examples | 1 | 0.5<br>5.0<br>10 | Direct Current | 200<br>25<br>15 | 50 | With Stirring |

TABLE 2-continued

Plating Conditions of Examples 1 to 9

| Items | | Plating Conditions: Cathode Current Density at Direct Current Portion or Peak Portion ($A/dm^2$) | Current Type | Plating Time (min) | Bath Temperature (° C.) | With/Without Stirring |
|---|---|---|---|---|---|---|
| | 2 | 0.5<br>5.0<br>10 | Direct Current | 200<br>25<br>15 | 50 | With Stirring |
| | 3 | 0.5<br>5.0<br>10 | Direct Current | 200<br>25<br>15 | 65 | With Stirring |

TABLE 2-continued

| Plating Conditions of Examples 1 to 9 | | | | | |
|---|---|---|---|---|---|
| | Plating Conditions | | | | |
| Items | Cathode Current Density at Direct Current Portion or Peak Portion ($A/dm^2$) | Current Type | Plating Time (min) | Bath Temperature (° C.) | With/ Without Stirring |
| 4 | 0.5<br>5.0<br>10 | Direct Current | 200<br>25<br>15 | 50 | With Stirring |
| 5 | 0.5<br>5.0<br>10 | Pulse Duty Ratio: 0.5 | 400<br>40<br>25 | 65 | With Stirring |
| 6 | 0.5<br>5.0<br>10 | Direct Current | 200<br>25<br>15 | 50 | With Stirring |

TABLE 2-continued

| Plating Conditions of Examples 1 to 9 | | | | | |
|---|---|---|---|---|---|
| | Plating Conditions | | | | |
| Items | Cathode Current Density at Direct Current Portion or Peak Portion ($A/dm^2$) | Current Type | Plating Time (min) | Bath Temperature (° C.) | With/ Without Stirring |
| 7 | 0.5<br>5.0<br>10 | Direct Current | 200<br>25<br>12.5 | 40 | With Stirring |
| 8 | 0.5<br>5.0<br>10 | Direct Current | 200<br>25<br>12.2 | 50 | With Stirring |
| 9 | 0.5<br>5.0<br>10 | Direct Current | 200<br>25<br>12.5 | 50 | With Stirring |

TABLE 3

| Results Obtained in Examples 1 to 5 | | | | | | | | | | | |
|---|---|---|---|---|---|---|---|---|---|---|---|
| | Obtained Results | | | | | | | | | | |
| | First Plated Coating · ORP During Plating | | | | | Fifth Plated Coating · ORP During Plating | | | | | Bath Stability (After Left to |
| Items | Plating Film Thickness μm | Plating Composition Cu% | Appearance and Color Tone | Smoothness and Glossiness of Surface | ORP mV Vs. Ag/AgCl | Plating Film Thickness μm | Plating Composition Cu% | Appearance and Color Tone | Smoothness and Glossiness of Surface | ORP mV Vs. Ag/AgCl | Stand for 7 Days at Room Temperature) |
| Examples 1 | 20 | 45 | Silver White | Semi-glossy Smooth | >100 | 20 | 47 | Silver White | Semi-glossy Smooth | >100 | No Turbidity |
| | 20 | 43 | Silver White | Semi-glossy Smooth | | 20 | 43 | Silver White | Semi-glossy Smooth | | |
| | 20 | 40 | Silver White | Semi-glossy Smooth | | 20 | 42 | Silver White | Semi-glossy Smooth | | |
| 2 | 20 | 65 | Silver White | Semi-glossy Smooth | >40 | 20 | 68 | Silver White | Semi-glossy Smooth | >40 | No Turbidity |
| | 20 | 62 | Silver White | Semi-glossy Smooth | | 20 | 65 | Silver White | Semi-glossy Smooth | | |
| | 20 | 60 | Silver White | Semi-glossy Smooth | | 20 | 61 | Silver White | Semi-glossy Smooth | | |
| 3 | 20 | 85 | cupronickel | Semi-glossy Smooth | >150 | 20 | 85 | cupronickel | Semi-glossy Smooth | >150 | No Turbidity |
| | 20 | 82 | cupronickel | Semi-glossy Smooth | | 20 | 83 | cupronickel | Semi-glossy Smooth | | |
| | 20 | 80 | cupronickel | Semi-glossy Smooth | | 20 | 83 | cupronickel | Semi-glossy Smooth | | |
| 4 | 20 | 50 | Silver White | Semi-glossy Smooth | >200 | 20 | 53 | Silver White | Semi-glossy Smooth | >200 | No Turbidity |
| | 20 | 46 | Silver White | Semi-glossy Smooth | | 20 | 46 | Silver White | Semi-glossy Smooth | | |
| | 20 | 45 | Silver White | Semi-glossy Smooth | | 20 | 47 | Silver White | Semi-glossy Smooth | | |

TABLE 3-continued

| Results Obtained in Examples 1 to 5 | | | | | | | | | | | |
|---|---|---|---|---|---|---|---|---|---|---|---|
| | Obtained Results | | | | | | | | | | |
| | First Plated Coating · ORP During Plating | | | | | Fifth Plated Coating · ORP During Plating | | | | | Bath Stability (After Left to |
| Items | Plating Film Thickness μm | Plating Composition Cu% | Appearance and Color Tone | Smoothness and Glossiness of Surface | ORP mV Vs. Ag/AgCl | Plating Film Thickness μm | Plating Composition Cu% | Appearance and Color Tone | Smoothness and Glossiness of Surface | ORP mV Vs. Ag/AgCl | Stand for 7 Days at Room Temperature) |
| 5 | 20 | 75 | Silver White | Semi-glossy Smooth | >70 | 20 | 74 | Silver White | Semi-glossy Smooth | >70 | No Turbidity |
| | 20 | 73 | Silver White | Semi-glossy Smooth | | 20 | 74 | Silver White | Semi-glossy Smooth | | |
| | 20 | 71 | Silver White | Semi-glossy Smooth | | 20 | 70 | Silver White | Semi-glossy Smooth | | |

TABLE 4

| Results Obtained in Examples 6 to 9 | | | | | | | | | | | |
|---|---|---|---|---|---|---|---|---|---|---|---|
| | Obtained Results | | | | | | | | | | |
| | First Plated Coating · ORP During Plating | | | | | Fifth Plated Coating · ORP During Plating | | | | | Bath Stability (After Left to |
| Items | Plating Film Thickness μm | Plating Composition Cu% | Appearance and Color Tone | Smoothness and Glossiness of Surface | ORP mV Vs. Ag/AgCl | Plating Film Thickness μm | Plating Composition Cu% | Appearance and Color Tone | Smoothness and Glossiness of Surface | ORP mV Vs. Ag/AgCl | Stand for 7 Days at Room Temperature) |
| Examples 6 | 20 | 87 | cupronickel | Semi-glossy Smooth | >120 | 20 | 85 | cupronickel | Semi-glossy Smooth | >120 | No Turbidity |
| | 20 | 89 | cupronickel | Semi-glossy Smooth | | 20 | 88 | cupronickel | Semi-glossy Smooth | | |
| | 20 | 91 | cupronickel | Semi-glossy Smooth | | 20 | 91 | cupronickel | Semi-glossy Smooth | | |
| 7 | 20 | 45 | Silver White | Semi-glossy Smooth | >20 | 20 | 44 | Silver White | Semi-glossy Smooth | >20 | No Turbidity |
| | 20 | 42 | Silver White | Semi-glossy Smooth | | 20 | 42 | Silver White | Semi-glossy Smooth | | |
| | 20 | 40 | Silver White | Semi-glossy Smooth | | 20 | 44 | Silver White | Semi-glossy Smooth | | |
| 8 | 20 | 65 | Silver White | Semi-glossy Smooth | >90 | 20 | 67 | Silver White | Semi-glossy Smooth | >90 | No Turbidity |
| | 20 | 61 | Silver White | Semi-glossy Smooth | | 20 | 65 | Silver White | Semi-glossy Smooth | | |
| | 20 | 60 | Silver White | Semi-glossy Smooth | | 20 | 64 | Silver White | Semi-glossy Smooth | | |

TABLE 4-continued

| Results Obtained in Examples 6 to 9 | | | | | | | | | | | |
|---|---|---|---|---|---|---|---|---|---|---|---|
| | Obtained Results | | | | | | | | | | |
| | First Plated Coating · ORP During Plating | | | | | Fifth Plated Coating · ORP During Plating | | | | | Bath Stability (After Left to |
| Items | Plating Film Thickness μm | Plating Composition Cu% | Appearance and Color Tone | Smoothness and Glossiness of Surface | ORP mV Vs. Ag/AgCl | Plating Film Thickness μm | Plating Composition Cu% | Appearance and Color Tone | Smoothness and Glossiness of Surface | ORP mV Vs. Ag/AgCl | Stand for 7 Days at Room Temperature) |
| 9 | 20 | 97 | Coppery | Semi-glossy Smooth | >160 | 20 | 97 | Coppery | Semi-glossy Smooth | >160 | No Turbidity |
| | 20 | 94 | Coppery | Semi-glossy Smooth | | 20 | 95 | Coppery | Semi-glossy Smooth | | |
| | 20 | 92 | Coppery | Semi-glossy Smooth | | 20 | 93 | Coppery | Semi-glossy Smooth | | |

TABLE 5

| Compositions of Plating Liquids of Comparative Examples 1 to 6 | | | | | | |
|---|---|---|---|---|---|---|
| Concentrations of Components | Comparative Examples 1 | 2 | 3 | 4 | 5 | 6 |
| (a) $Cu^{2+}$ (g/L) | 5 | 10 | 10 | 15 | 15 | 15 |
| (a) $Ni^{2+}$ (g/L) | 10 | 10 | 5 | 25 | 15 | 5 |
| Concentration of Metals (mol/L) ($Cu2^{+}$ + $Ni^{2+}$) | 0.25 | 0.33 | 0.24 | 0.66 | 0.49 | 0.32 |
| (b) Malonic Acid (mol/L) | 0.38 | — | — | 0.99 | — | — |
| (b) Citric Acid (mol/L) | — | — | 0.24 | — | — | 0.22 |
| (b) Nitrilotriacetic Acid (mol/L) | — | 0.23 | — | — | 0.49 | — |
| Metal Complexing Agent/Metal Molar Concentration Ratio (Fold) | 1.5 | 0.7 | 1.0 | 1.5 | 1.0 | 0.7 |
| (c) Sodium Chloride (mol/L) | 0.2 | 0.25 | — | 1.0 | 0.5 | — |
| (c) Potassium Bromide (mol/L) | — | — | 0.2 | — | — | 0.25 |
| (c) Magnesium Sulfate (mol/L) | — | — | 0.5 | — | — | 0.75 |
| (c) Sodium Methanesulfonate (mol/L) | — | 1.25 | — | — | 0.5 | — |
| (d) Bis-sodium Sulfopropyl Disulfide (g/L) | 0.05 | — | 0.1 | 4.0 | — | 0.5 |
| (d) Cysteine Methanesulfonate (g/L) | — | 2.0 | — | — | 1.0 | — |
| (d) Sodium 1,5-naphthalenedi sulfonate (g/L) | — | — | — | 4.0 | — | — |
| (d) Saccharin Sodium (g/L) | — | 2.0 | — | — | — | 1.0 |
| (e) 35%-Hydrogen Peroxide Solution (g/L) | — | — | — | — | — | — |

TABLE 5-continued

| Compositions of Plating Liquids of Comparative Examples 1 to 6 | | | | | | |
|---|---|---|---|---|---|---|
| Concentrations of Components | Comparative Examples 1 | 2 | 3 | 4 | 5 | 6 |
| (e) Peroxyacetic Acid (g/L) | — | — | — | — | — | — |
| (e) Boric Acid (g/L) | — | — | — | — | — | — |
| (e) Succinic Acid (g/L) | — | — | — | — | — | — |
| Reaction Product of Ethylene Glycol Diglycidyl Ether and Propylene Glycol (g/L) | — | — | — | — | 2.0 | — |
| Reaction Product of Glycerol Polyglycidyl Ether and Polyglycerin (g/L) | — | — | — | 0.2 | — | — |
| Polyethylene Glycol (g/L) | — | — | 1.0 | — | — | — |
| pH | 4 | 5 | 6 | 3 | 8 | 6 |
| ORP Before Plating Energization (mV) | 300 | 280 | 176 | 260 | 140 | 176 |

Types of Copper Salts: copper(II) sulfamate (Comparative Examples 1 and 4), copper(II) sulfate (Comparative Examples 3 and 6), copper(II)methanesulfonate (Comparative Examples 2 and 5)

Types of Nickel Salts: nickel sulfamate (Comparative Examples 1 and 4), nickel sulfate (Comparative Examples 3 and 6), nickel methanesulfonate (Comparative Examples 2 and 5)

pH modifiers: sodium hydroxide (Comparative Examples 1, 2, 4, and 5), potassium hydroxide (Comparative Examples 3 and 6)

TABLE 6

Plating Conditions of Comparative Examples 1 to 6

| Items | | Plating Conditions: Cathode Current Density at Direct Current Portion or Peak Portion ($A/dm^2$) | Current Type | Plating Time (min) | Bath Temperature (° C.) | With/Without Stirring |
|---|---|---|---|---|---|---|
| Comparative Examples | 1 | 0.5<br>5.0<br>10 | Direct Current | 200<br>25<br>15 | 50 | With Stirring |
| | 2 | 0.5<br>5.0<br>10 | Pulse Duty Ratio: 0.5 | 400<br>40<br>25 | 65 | With Stirring |
| | 3 | 0.5<br>5.0<br>10 | Direct Current | 200<br>25<br>15 | 50 | With Stirring |

TABLE 6-continued

Plating Conditions of Comparative Examples 1 to 6

| Items | | Plating Conditions: Cathode Current Density at Direct Current Portion or Peak Portion ($A/dm^2$) | Current Type | Plating Time (min) | Bath Temperature (° C.) | With/Without Stirring |
|---|---|---|---|---|---|---|
| | 4 | 0.5<br>5.0<br>10 | Direct Current | 200<br>25<br>12.5 | 40 | With Stirring |
| | 5 | 0.5<br>5.0<br>10 | Direct Current | 200<br>25<br>12.5 | 50 | With Stirring |
| | 6 | 0.5<br>5.0<br>10 | Direct Current | 200<br>25<br>12.5 | 50 | With Stirring |

TABLE 7

Results Obtained in Comparative Examples 1 to 6

| Items | | Obtained Results: First Plated Coating · ORP During Plating: Plating Film Thickness μm | Plating Composition Cu% | Appearance and Color Tone | Smoothness and Glossiness of Surface | ORP mV Vs. Ag/AgCl | Fifth Plated Coating · ORP During Plating: Plating Film Thickness μm | Plating Composition Cu% | Appearance and Color Tone | Smoothness and Glossiness of Surface | ORP mV Vs. Ag/AgCl | Bath Stability (After Left to Stand for 7 Days at Room Temperature) |
|---|---|---|---|---|---|---|---|---|---|---|---|---|
| Comparative Examples | 1 | 20 | 49 | Silver White | Semi-glossy Smooth | Without Preparation >40 | 20 | 98 | Coppery | Not Glossy Coarse Deposition | Without Preparation <10 | No Turbidty |
| | | 20 | 45 | Silver White | Semi-glossy Smooth | | 20 | 55 | Silver White | Semi-glossy Smooth | | |
| | | 20 | 43 | Silver White | Semi-glossy Smooth | | 20 | 50 | Silver White | Semi-glossy Smooth | | |
| | 2 | 20 | 77 | Silver White | Semi-glossy Smooth | Without Preparation >70 | 20 | 85 | cupronickel | Semi-glossy Smooth | Without Preparation <10 | No Turbidty |
| | | 20 | 75 | Silver White | Semi-glossy Smooth | | 20 | 83 | cupronickel | Semi-glossy Smooth | | |
| | | 20 | 72 | Silver White | Semi-glossy Smooth | | 20 | 81 | cupronickel | Semi-glossy Smooth | | |
| | 3 | 20 | 88 | cupronickel | Semi-glossy Smooth | Without Preparation >40 | 20 | 100 | Coppery | Not Glossy Coarse Deposition | Without Preparation <10 | No Turbidty |
| | | 20 | 88 | cupronickel | Semi-glossy Smooth | | 20 | 98 | Coppery | Not Glossy Coarse Deposition | | |
| | | 20 | 91 | cupronickel | Semi-glossy Smooth | | 20 | 95 | cupronickel | Semi-glossy Smooth | | |
| | 4 | 20 | 47 | Silver White | Semi-glossy Smooth | Without Preparation >20 | 20 | 98 | Coppery | Not Glossy Coarse Deposition | Without Preparation <10 | No Turbidty |
| | | 20 | 44 | Silver White | Semi-glossy Smooth | | 20 | 62 | cupronickel | Semi-glossy Smooth | | |
| | | 20 | 42 | Silver White | Semi-glossy Smooth | | 20 | 60 | cupronickel | Semi-glossy Smooth | | |

TABLE 7-continued

| Results Obtained in Comparative Examples 1 to 6 | | | | | | | | | | | |
|---|---|---|---|---|---|---|---|---|---|---|---|
| | Obtained Results | | | | | | | | | | |
| | First Plated Coating · ORP During Plating | | | | | Fifth Plated Coating · ORP During Plating | | | | | Bath Stability (After Left to |
| Items | Plating Film Thickness μm | Plating Composition Cu% | Appearance and Color Tone | Smoothness and Glossiness of Surface | ORP mV Vs. Ag/AgCl | Plating Film Thickness μm | Plating Composition Cu% | Appearance and Color Tone | Smoothness and Glossiness of Surface | ORP mV Vs. Ag/AgCl | Stand for 7 Days at Room Temperature) |
| 5 | 20 | 67 | Silver White | Semi-glossy Smooth | Without Preparation >30 | 20 | 97 | Coppery | Not Glossy Coarse Deposition | Without Preparation <10 | No Turbidty |
| | 20 | 63 | Silver White | Semi-glossy Smooth | | 20 | 71 | cupronickel | Semi-glossy Smooth | | |
| | 20 | 60 | Silver White | Semi-glossy Smooth | | 20 | 65 | cupronickel | Semi-glossy Smooth | | |
| 6 | 20 | 97 | Coppery | Semi-glossy Smooth | Without Preparation >50 | 20 | 100 | Coppery | Not Glossy Coarse Deposition | Without Preparation <10 | No Turbidty |
| | 20 | 94 | Coppery | Semi-glossy Smooth | | 20 | 98 | Coppery | Not Glossy Coarse Deposition | | |
| | 20 | 92 | Coppery | Semi-glossy Smooth | | 20 | 95 | cupronickel | Semi-glossy Smooth | | |

We claim:

1. A copper-nickel alloy electroplating bath comprising:

(a) a copper salt and a nickel salt;

(b) a metal complexing agent;

(c) a conductivity providing salt;

(d) a sulfur-containing organic compound; and (e) an oxidation-reduction potential adjusting agent selected from the group consisting of hydrogen peroxide solutions, halogen oxoacids and alkali metal salts thereof, persulfuric acid and alkali metal salts thereof, and percarboxylates.

2. The copper-nickel alloy electroplating bath according to claim 1, wherein an oxidation-reduction potential (ORP) of the plating bath during plating operation is higher than or equal to 20 mV vs. Ag/AgCl.

3. The copper-nickel alloy electroplating bath according to claim 2, wherein the oxidation-reduction potential higher than or equal to 20 mV vs. Ag/AgCl is obtained by adjustment using the oxidation-reduction potential adjusting agent.

4. The copper-nickel alloy electroplating bath according to claim 1, wherein a copper/nickel composition ratio of a copper-nickel alloy electroplated coating is 5/95 to 95/5.

5. The copper-nickel alloy electroplating bath according to claim 1, wherein the copper-nickel alloy electroplating bath is used to plate a substrate of a metal selected from the group consisting of copper, iron, nickel, silver, gold, and alloys thereof, or a substrate having a substrate surface modified with the metal or alloy.

6. The copper-nickel alloy electroplating bath according to claim 1, wherein (c) the conductivity providing salt is selected from the group consisting of inorganic halide salts, inorganic sulfates, lower alkane sulfonates, alkanol sulfonates, and a combination thereof, and (d) the sulfur-containing organic compound is selected from the group consisting of disulfide compounds and salts thereof, sulfur-containing amino acids and salts thereof, benzothiazolylthio compounds and salts thereof, and a combination thereof.

7. The copper-nickel alloy electroplating bath according to claim 1, wherein the bath comprises the oxidation-reduction potential adjusting agent in an amount of 0.01 to 5 g/L and the oxidation-reduction potential adjusting agent is selected from the group consisting of halogen oxoacids and alkali metal salts thereof, persulfuric acid and alkali metal salts thereof, percarboxylates and a combination thereof.

* * * * *